US011608635B2

(12) United States Patent
Czyzewicz et al.

(10) Patent No.: US 11,608,635 B2
(45) **Date of Patent: *Mar. 21, 2023**

(54) SUPPORT MEMBER FOR CEILING SYSTEM

(71) Applicant: CERTAINTEED CEILINGS CORPORATION, Malvern, PA (US)

(72) Inventors: Robin C. Czyzewicz, Wilmington, DE (US); Bryan Neubeker, Alberta (CA); Matthew Rapposelli, Conshohocken, PA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/307,410

(22) Filed: May 4, 2021

(65) Prior Publication Data

US 2021/0324626 A1 Oct. 21, 2021

Related U.S. Application Data

(63) Continuation of application No. 16/842,186, filed on Apr. 7, 2020, now Pat. No. 10,995,490, which is a (Continued)

(51) Int. Cl.
*E04B 9/06* (2006.01)
*E04B 9/12* (2006.01)
(Continued)

(52) U.S. Cl.
CPC ..... *E04B 9/067* (2013.01); *E04B 9/068* (2013.01); *E04B 9/127* (2013.01); *E04B 9/18* (2013.01); *E04B 9/183* (2013.01); *E04B 9/241* (2013.01)

(58) Field of Classification Search
CPC . E04B 9/18; E04B 9/067; E04B 9/068; E04B 9/183; E04B 9/241; E04B 2009/062
(Continued)

(56) References Cited

U.S. PATENT DOCUMENTS 3,189,139 A 6/1965 Znamirowski et al.
3,397,501 A 8/1968 Jahn
(Continued)

FOREIGN PATENT DOCUMENTS

EP 3 037 061 A1 10/1981
KR 2009001851 U 11/2009

OTHER PUBLICATIONS

International Search Report and Written Opinion for PCT/US2017/061329, dated Mar. 1, 2018.

*Primary Examiner* — Brian E Glessner
*Assistant Examiner* — James J Buckle, Jr.
(74) *Attorney, Agent, or Firm* — McDonnell Boehnen Hulbert & Berghoff LLP

(57) ABSTRACT

The disclosure relates to support members for ceiling systems, such as those that can be formed into an interconnected grid to be suspended from a ceiling and support ceiling tiles. One aspect of the disclosure is a linearly-extending support member for a ceiling tile. The support member has a cross-sectional shape that includes a substantially vertical central web with a top end and a bottom end; at least one flange extending substantially horizontally from the bottom end of the web, the flange having an upper surface and a lower surface; and a bulb extending from the top end of the web, the bulb having a first side and a second side with a cavity therebetween, the bulb having an upper portion and a lower portion adjacent the top end of the web, wherein the entire lower portion of the bulb is narrower than the upper portion of the bulb and wider than the central web, the bulb comprising a series of spaced apertures formed therein through both the first side and the second side of the bulb, each aperture being disposed at least partially in the lower portion of the bulb, each aperture having an upper
(Continued)

portion and a lower portion, wherein the upper portion of the aperture is rounded.

18 Claims, 16 Drawing Sheets

Related U.S. Application Data continuation of application No. 16/413,318, filed on May 15, 2019, now Pat. No. 10,648,177, which is a continuation of application No. 15/811,034, filed on Nov. 13, 2017, now Pat. No. 10,316,514.

(60) Provisional application No. 62/421,783, filed on Nov. 14, 2016.

(51) Int. Cl.
*E04B 9/18* (2006.01)
*E04B 9/24* (2006.01)
*E04C 3/04* (2006.01)

(58) Field of Classification Search
USPC ..... 52/506.07
See application file for complete search history.

(56) References Cited

U.S. PATENT DOCUMENTS

| | | | |
|---|---|---|---|
| 3,846,031 | A | 11/1974 | Adams |
| 4,016,701 | A | 4/1977 | Beynon |
| 4,817,357 | A | 4/1989 | Hocevar |
| 4,838,002 | A | 6/1989 | Dajnko et al. |
| 5,313,750 | A | 5/1994 | Frecska et al. |
| 5,349,803 | A | 9/1994 | Nute, Jr. |
| 5,761,869 | A | 6/1998 | Tinen et al. |
| 7,516,585 | B2 | 4/2009 | Lehane, Jr. et al. |
| 7,520,095 | B2 | 4/2009 | Platt |
| 7,578,107 | B2 | 8/2009 | Platt |
| 7,832,168 | B2 | 11/2010 | Lehane et al. |
| D672,476 | S | 12/2012 | Field et al. |
| 8,381,486 | B1 | 2/2013 | Lehane, Jr. et al. |
| 8,397,462 | B2 | 3/2013 | Gulbrandsen et al. |
| 8,424,268 | B2 | 4/2013 | Field et al. |
| 9,091,050 | B2 | 7/2015 | Boyd |
| 9,416,536 | B1 | 8/2016 | Lehane et al. |
| 10,316,514 | B2 | 6/2019 | Czyzewicz |
| 10,648,177 | B2 | 5/2020 | Czyzewicz |
| 10,995,490 | B2 | 5/2021 | Czyzewicz |
| 2003/0101675 | A1 | 6/2003 | Wilson |
| 2008/0148668 | A1 | 6/2008 | Jahn et al. |
| 2008/0155927 | A1 | 7/2008 | Wendt et al. |
| 2008/0155935 | A1 | 7/2008 | Raheel et al. |
| 2011/0023400 | A1 | 2/2011 | Field et al. |

SUPPORT MEMBER FOR CEILING SYSTEM

CROSS REFERENCE TO RELATED APPLICATIONS

The present application is a continuation of U.S. patent application Ser. No. 16/413,318, filed May 15, 2019, which is a continuation of U.S. patent application Ser. No. 15/811,034, filed Nov. 13, 2017, now U.S. Pat. No. 10,316,514, which claims priority to U.S. Provisional Patent Application No. 62/421,783, filed Nov. 14, 2016. The entire disclosure contents of these applications are herewith incorporated by reference into the present application.

The disclosure of U.S. Design patent application Ser. No. 29/584,372, filed Nov. 14, 2016, is hereby incorporated herein by reference in its entirety.

BACKGROUND

Field of the Disclosure

The disclosure generally relates to ceiling systems. The disclosure relates more specifically to support members for ceiling systems.

Description of Related Art

Ceiling systems typically comprise a series of roll-formed, metallic support members that form a grid. The grid is suspended from a structure and supports a plurality of ceiling tiles, providing a ceiling beneath the structure that may provide sound insulation, heat insulation, aesthetic appeal, etc.

Conventional support members often have a cross-sectional shape in the form of an inverted "T," comprising a vertical central web, a reinforcing bulb extending from the top end of the web, and two flanges extending horizontally from the bottom end of the web. Rounded apertures for receiving a hanger suspended from a structure are typically provided in the central web of conventional support members, but are located low on the structure, near the flanges. When such apertures are utilized for suspending the support member, the hanger may interfere with other components of a ceiling system, such as ceiling tiles.

Rectangular apertures are often included in the reinforcing bulb of conventional support members. Such rectangular apertures are a vestigial product of the manufacturing process, and as such are not intended for, or properly designed for, receiving a hanger and properly distributing the stress caused by suspension of the support member. Additionally, threading a hanger through such apertures may be difficult because the apertures are formed through a wide reinforcing bulb, wherein the sides of the bulb are relatively far apart. Despite this, such rectangular apertures are often used for suspending the support members of a ceiling system, resulting in difficultly and improperly suspended ceiling systems.

Accordingly, there remains a need for ceiling suspension system support members that facilitate the threading of a hanger through the apertures of the support members and evenly distribute the stress caused by suspension of the support members from the apertures of the support members.

SUMMARY

One aspect of the disclosure relates to a linearly-extending support member for a ceiling tile, the support member having a length and a cross-sectional shape including a substantially vertical central web with a top end and a bottom end;

at least one flange extending substantially horizontally from the bottom end of the web, the flange having an upper surface and a lower surface; and a bulb extending from the top end of the web, the bulb having a first side and an opposed second side with a cavity therebetween, the bulb having an upper portion and a lower portion, the lower portion of the bulb being disposed adjacent the top end of the web, wherein the entire lower portion of the bulb is narrower than the upper portion of the bulb and wider than the central web, the bulb comprising a series of spaced apertures formed therein through both the first side and the second side of the bulb, each aperture being disposed at least partially through the lower portion of the bulb, each aperture having an upper portion and a lower portion, wherein the upper portion of the aperture is rounded.

Another aspect of the disclosure relates to a ceiling system including a support member as described herein, suspended from a structure (e.g., a ceiling) by a hanger disposed through one of the apertures of the support member. In certain embodiments, such a ceiling system further includes a ceiling tile having an edge resting on the upper surface of the flange of the support member.

Other aspects of the disclosure will be apparent to the person of ordinary skill in the art based on the drawings and detailed description below.

DETAILED DESCRIPTION

Figure 1:
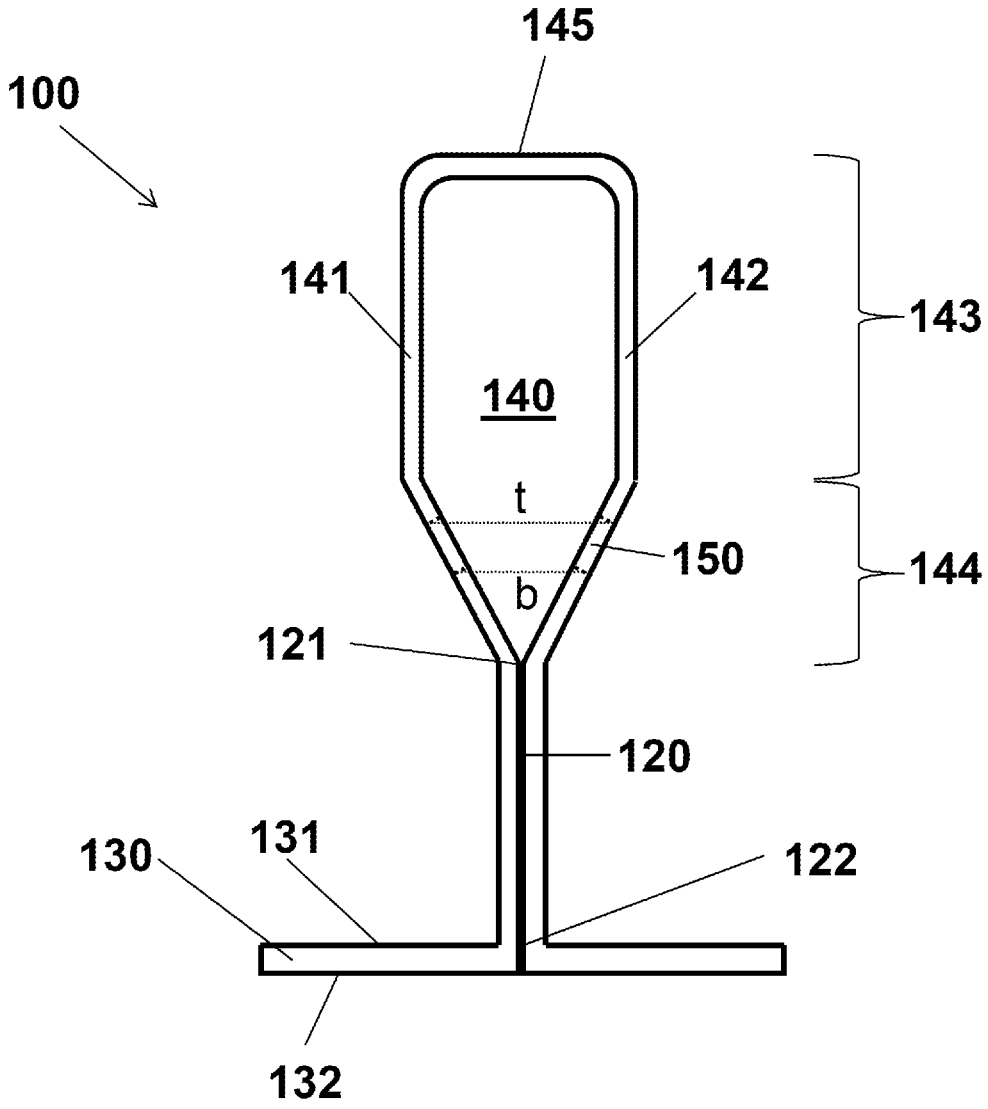
FIG. 1 is a schematic cross-sectional view of a support member according to one embodiment of the disclosure.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice. Thus, before the disclosed processes and devices are described, it is to be understood that the aspects described herein are not limited to specific embodiments, apparati, or configurations, and as such can, of course, vary. It is also to be understood that the terminology used herein is for the purpose of describing particular aspects only and, unless specifically defined herein, is not intended to be limiting.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

All methods described herein can be performed in any suitable order of steps unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

As will be understood by one of ordinary skill in the art, each embodiment disclosed herein can comprise, consist essentially of or consist of its particular stated element, step, ingredient or component. As used herein, the transition term "comprise" or "comprises" means includes, but is not limited to, and allows for the inclusion of unspecified elements, steps, ingredients, or components, even in major amounts. The transitional phrase "consisting of" excludes any element, step, ingredient or component not specified. The transition phrase "consisting essentially of" limits the scope of the embodiment to the specified elements, steps, ingredients or components and to those that do not materially affect the embodiment.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. When further clarity is required, the term "about" has the meaning reasonably ascribed to it by a person skilled in the art when used in conjunction with a stated numerical value or range, i.e., denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Some embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

As the person of ordinary skill in the art will appreciate, directions such as "vertical," "horizontal," "upper" and "lower" are defined relative to how the support member is to be installed, with the ceiling defined as "up."

Furthermore, numerous references have been made to patents and printed publications throughout this specification. Each of the cited references and printed publications are individually incorporated herein by reference in their entirety.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

In various aspects and embodiments, the disclosure relates to support members for ceiling systems. The disclosure demonstrates such support members to facilitate the threading of a hanger through apertures in the support members, and to more evenly distribute the stress caused by suspension of the support members from one or more apertures. One aspect of the disclosure is a linearly-extending support member for a ceiling tile, the linearly-extending support member having a length and a cross-sectional shape. The cross-sectional shape includes a substantially vertical central web with a top end and a bottom end, at least one flange extending substantially horizontally from the bottom end of the web, and a bulb extending from the top end of the web. The flange of the support member has an upper and a lower surface. The bulb of the support member has a first side and a second side with a cavity therebetween. The bulb of the support member also has an upper portion and a lower portion, wherein the lower portion of the bulb is narrower than the upper portion of the bulb and wider than the central web. The bulb of the support member comprises a series of spaced apertures formed therein through both the first side and the second side of the bulb. Each aperture is disposed at least partially in the lower portion of the bulb. Each aperture has an upper portion and a lower portion, wherein the upper portion of the aperture is rounded. The inventors have determined that the rounded apertures of the disclosure distribute stress on the support member caused by suspension from a structure (e.g., a ceiling) by a hanger threaded through one of the apertures more evenly than, e.g., a rectangular aperture or a square aperture. Moreover, the fact that the opposing surfaces of the bulb are closer together over at least part of their height than the full width of the bulb simplifies insertion of a hanger through each aperture.

Figure 2:
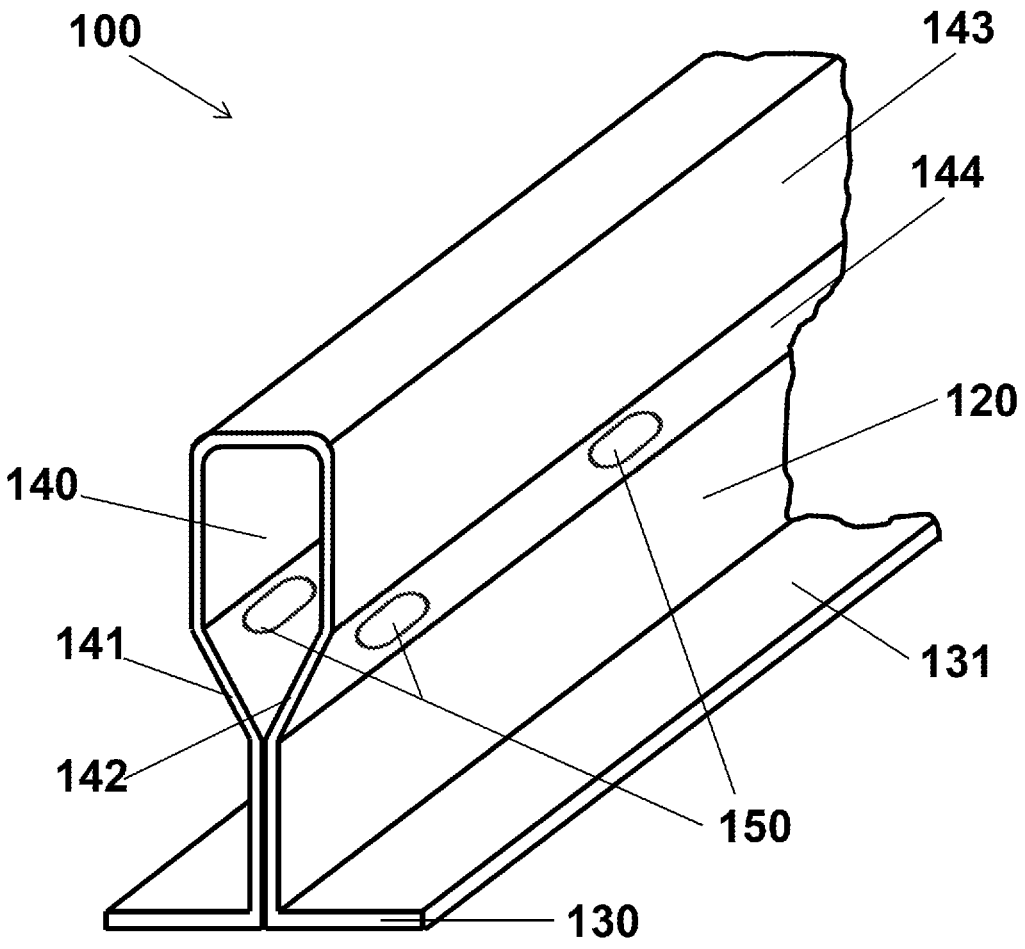
FIG. 2 is a partial schematic perspective view of the support member of FIG. 1.
Figure 3:
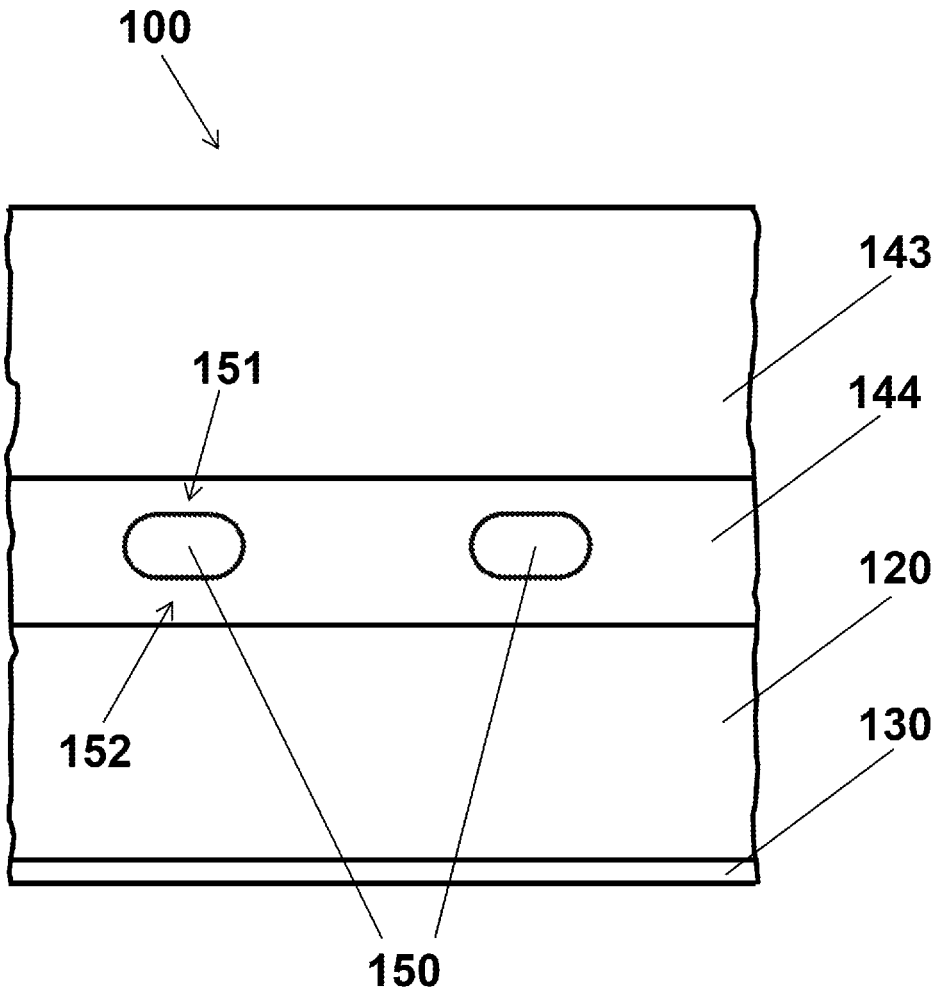
FIG. 3 is a partial schematic side view of a support member of FIGS. 1 and 2.

One embodiment of the disclosure is shown in schematic view in FIGS. 1-3. Support member 100 includes a substantially vertical central web 120 having a top end 121 and a bottom end 122. As used herein, a "web" is a linear member formed from one or more thicknesses of material, e.g., as shown in FIG. 1. Support member 100 also includes at least one flange 130 extending substantially horizontally from bottom end 122 having an upper surface 131 and a lower surface 132. Support member 100 includes two such flanges, but as the person of ordinary skill in the art will appreciate, in other embodiments only one flange may be present. Support member 100 also includes a bulb 140 extending from the top end 121 of the web. The bulb 140 has a first side 141 and an opposed second side 142, with a cavity therebetween. Bulb 140 also has an upper portion 143 and a lower portion 144, and a top end 145. The entire lower portion of the bulb is narrower than the upper portion of the bulb, but is wider than the central web. In certain embodiments, such as shown in FIGS. 1-3, the lower portion of the bulb is disposed immediately adjacent the top end of the web.

Bulb 140 includes a series of spaced apertures 150 formed therein through both the first side 141 and the second side 142 of the bulb. As the person of ordinary skill in the art will appreciate, a single "aperture" will actually have two holes—one formed through the first side of the bulb and another formed in the opposed second side of the bulb. Each aperture is disposed at least partially through the lower portion 144 of the bulb. Each aperture has an upper portion 151 and a lower portion 152, with the upper portion 151 of each aperture being rounded (i.e., lacking any substantial corners). For example, in certain embodiments of the devices as otherwise described herein, "rounded" describes a feature having an angle of less than 135 degrees and a radius of curvature in excess of 0.5 mm, 1 mm, or even 2 mm. In certain such embodiments, a "rounded" feature has a radius of curvature less than 10 mm, less than 7 mm, or even less than 5 mm. Thus, in certain embodiments of the devices as otherwise described herein, the upper portion of each of the apertures does not include a feature having an angle of less than 135 degrees and a radius of curvature less than 2 mm, less than 1 mm, or less than 0.5 mm. In certain embodiments of the devices as otherwise described herein, the lower portion of each of the apertures does not include a feature having an angle of less than 135 degrees and a radius of curvature less than 2 mm, less than 1 mm, or less than 0.5 mm.

The person of ordinary skill in the art will appreciate that the structure of a support member as shown in FIGS. 1-3, which includes only eight bends, may be manufactured relatively easily, e.g., by roll-forming, as described in more detail below.

In some embodiments of the devices as otherwise described herein, the lower portion of each aperture is also rounded. For example, in the embodiment shown in FIG. 3, lower portion 152 is rounded, such that the apertures form generally oval shapes. As the person of ordinary skill in the art will appreciate, the apertures can take a variety of shapes in which the entire aperture is rounded, e.g., oval as shown above. For example, in some embodiments, each aperture is circular, such as the circular apertures 250 of the embodiment shown in schematic view in FIG. 4. The person of ordinary skill in the art will appreciate that other rounded shapes, such as ellipses or irregular rounded shapes, can likewise be used for the apertures.

Figure 5:
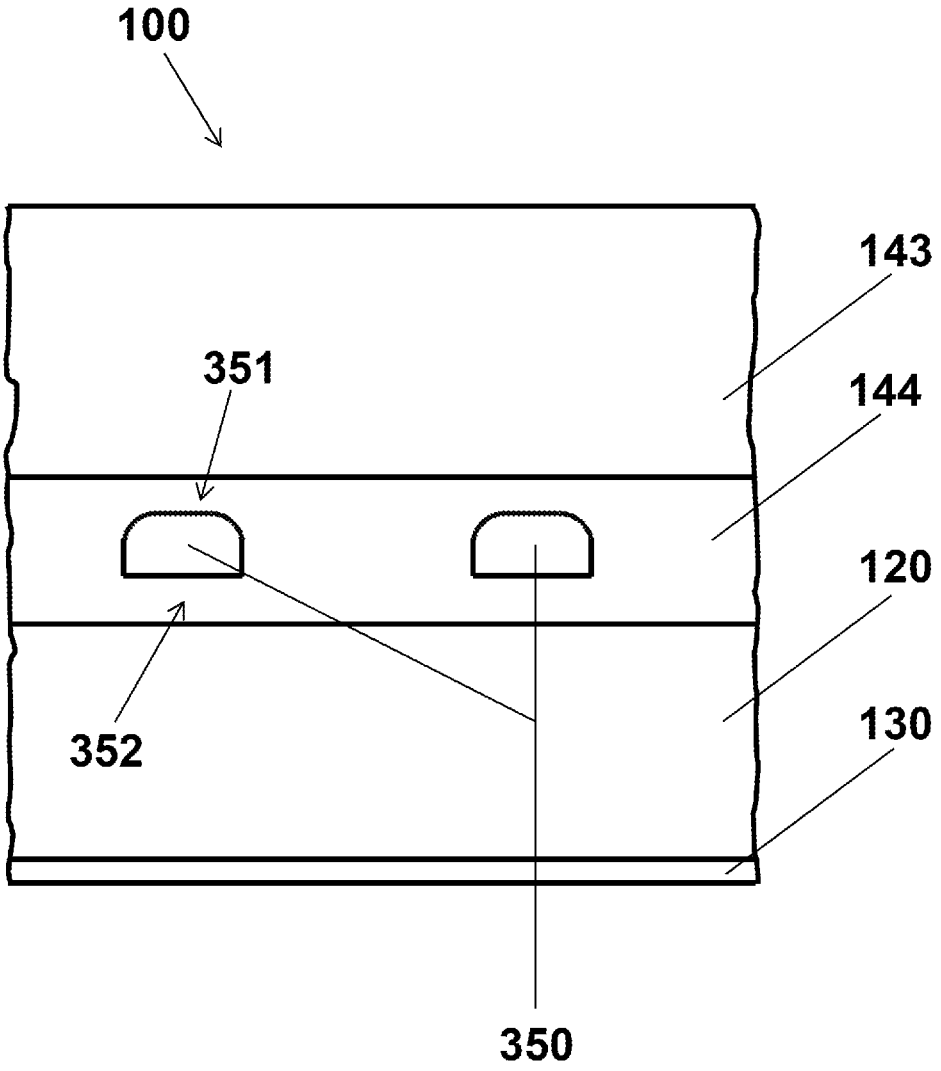
FIG. 5 is a partial schematic side view of a support member according to another embodiment of the disclosure.

In certain alternative embodiments of the devices as otherwise described herein, the lower portion of each aperture is not rounded. For example, in the embodiment shown in schematic view in FIG. 5, apertures 350 have an upper portion 351 and a lower portion 352, wherein only upper portion 351 is rounded. The apertures can be, for example, "D"-shaped, as shown in FIG. 5. Such an aperture can be conveniently fabricated, for example, by punching an outline of all but the major straight side of a "D" into each side of the bulb, then folding the "D" shaped material section so formed down into the interior of the bulb. But the person of ordinary skill in the art will appreciate that other shapes can be used.

In certain embodiments of the device as otherwise described herein, the apertures are elongated in a direction parallel to the length of the support member. For example, in the embodiment shown in FIG. 3, apertures 150 are elongated in a direction parallel to the length of the support member. Similarly, the "D"-shaped apertures 350 of the embodiment of FIG. 5 are elongated in a direction parallel to the length of the support member.

Figure 6:
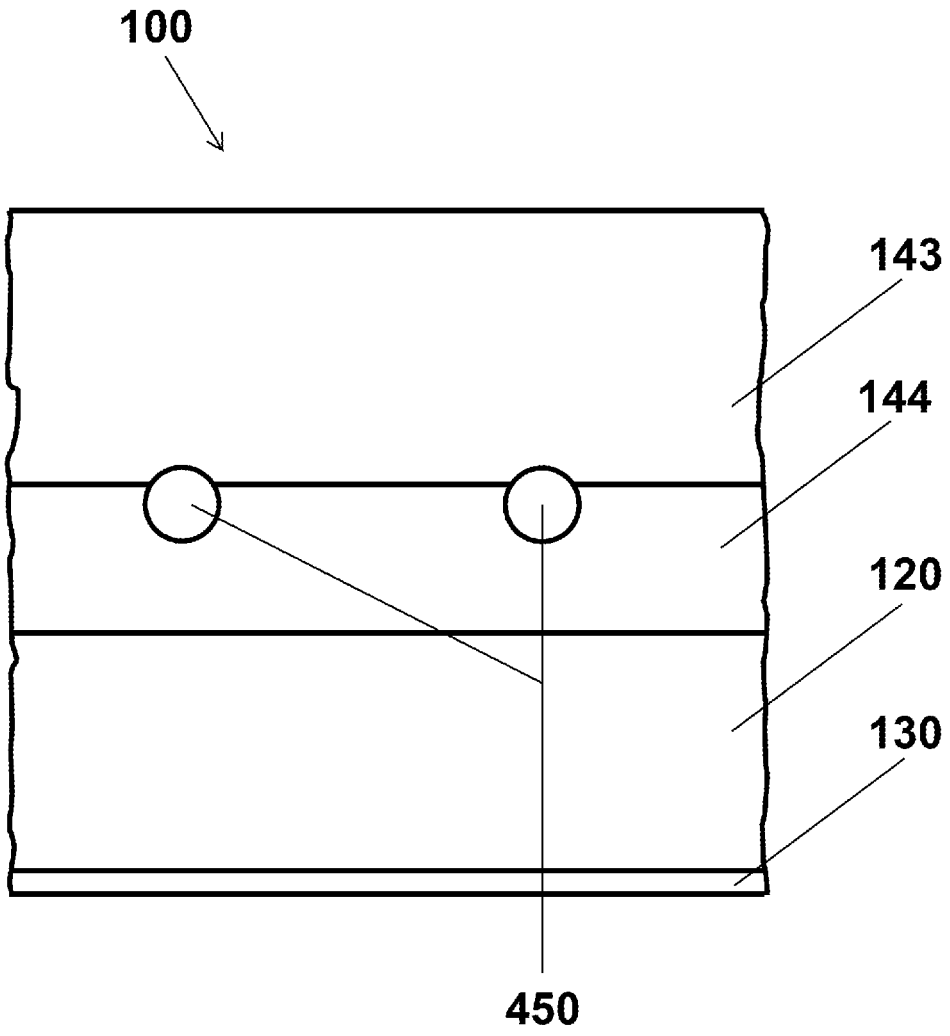
FIG. 6 is a partial schematic side view of a support member according to another embodiment of the disclosure.

In certain embodiments of the devices as otherwise described herein, the apertures are disposed entirely in the lower portion of the bulb. For example, in the embodiment shown in FIG. 3, apertures 150 are disposed entirely in lower portion 144 of the bulb. But in certain alternative embodiments of the devices as otherwise described herein, the apertures are only partially disposed in the lower portion of the bulb, and partially disposed in the upper portion of the bulb. For example, in the embodiment shown in schematic view in FIG. 6, apertures 450 are partially disposed in lower portion 144 of the bulb and partially disposed in upper portion 143 of the bulb. Without intending to be bound by theory, the inventors believe that this can be advantaged, in that the top part of an aperture can be in a wider part of the bulb, with the bottom part of the aperture in a narrower part of the bulb, such that it is easier to feed a hanger through the aperture in the opposed first and second sides of the bulb, but the hanger can contact the first and second sides of the aperture in the upper portion of the bulb where the first and second sides are wider to provide additional stability to the hung support member.

Figure 7:
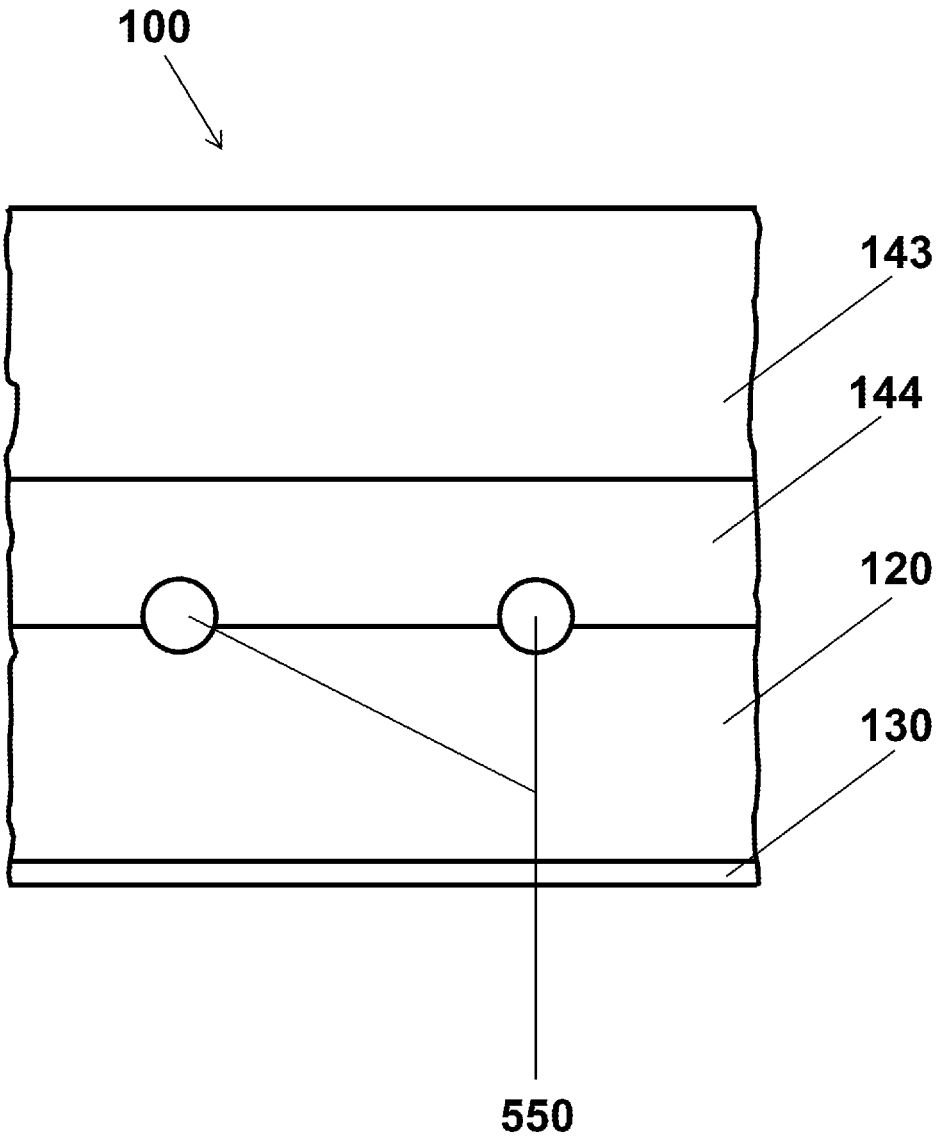
FIG. 7 is a partial schematic side view of a support member according to another embodiment of the disclosure.
Figure 8:
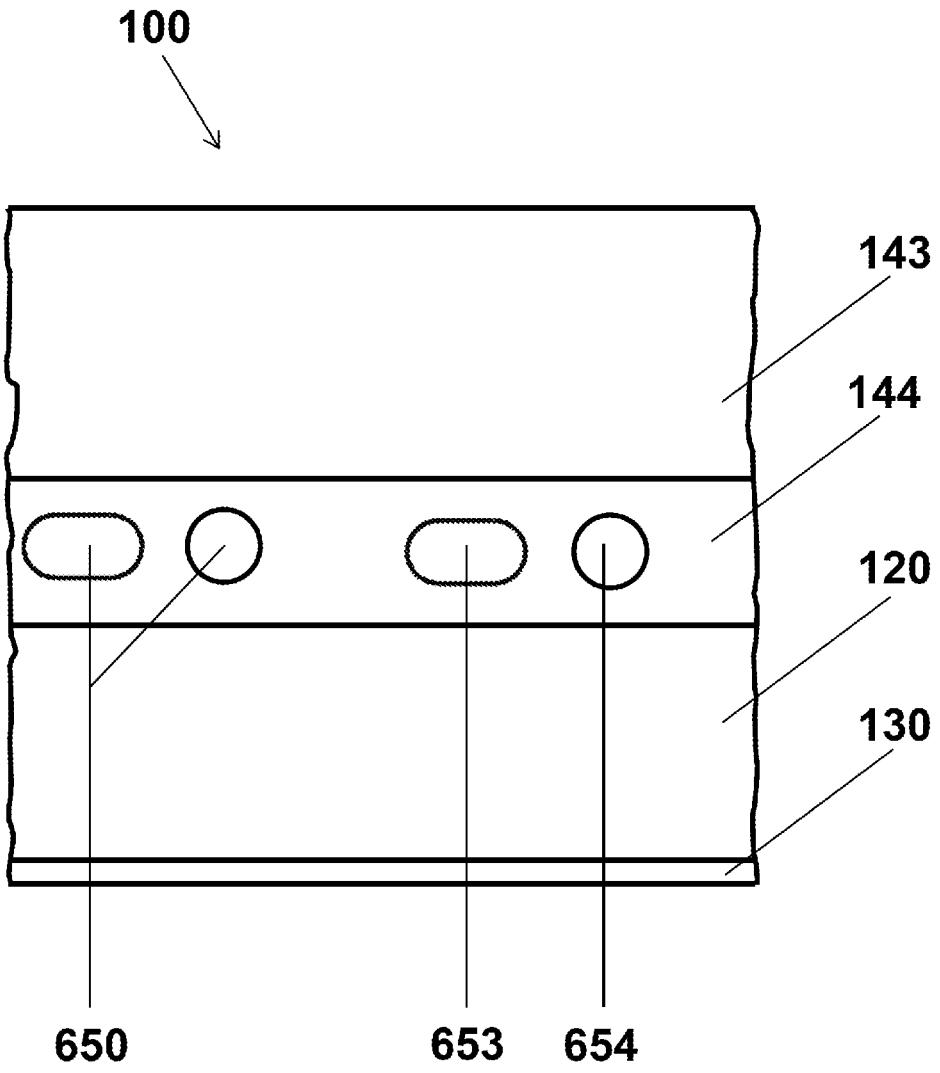
FIG. 8 is a partial schematic side view of a support member according to another embodiment of the disclosure.
Figure 9:
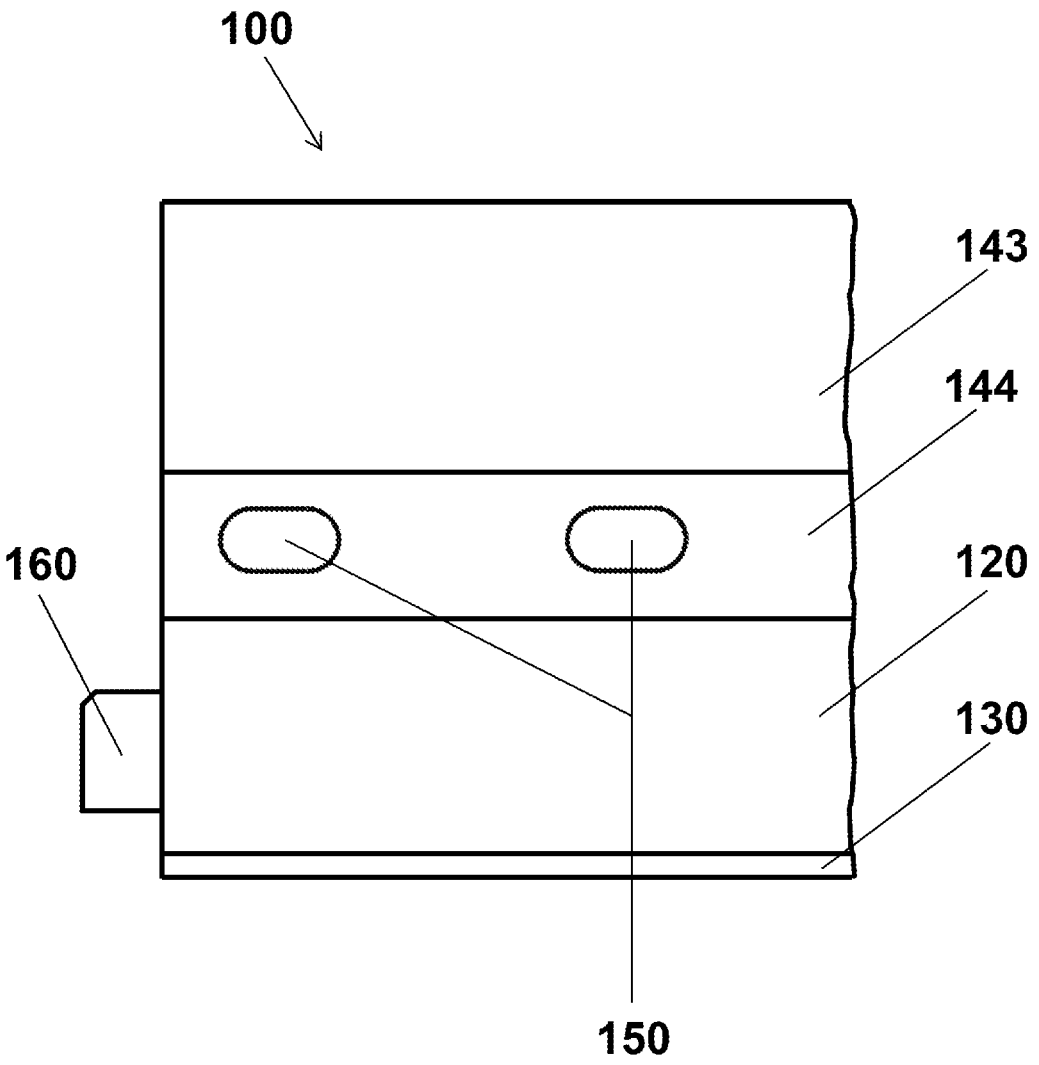
FIG. 9 is a partial schematic side view of an end of a support member according to another embodiment of the disclosure.
Figure 10:
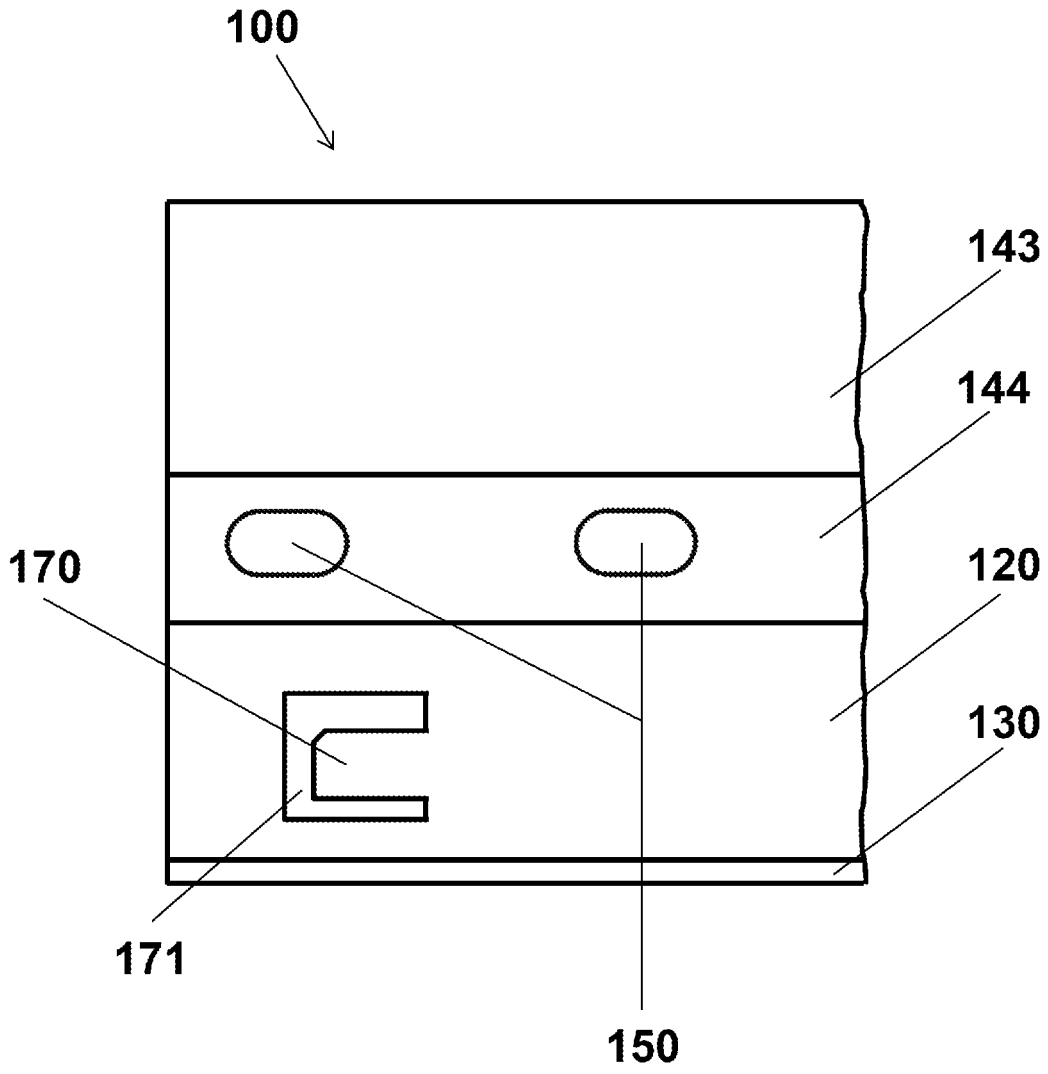
FIG. 10 is a partial schematic side view of an end of a support member according to another embodiment of the disclosure.

Alternative, in other embodiments, the apertures are formed partially in the lower portion of the bulb and partially in the central web. For example, in the embodiment shown in schematic view in FIG. 7, apertures 550 are partially disposed in the lower portion 144 of the bulb and partially disposed in central web 120.

In certain embodiments, e.g., as shown in FIGS. 1-5 and 7-10, the upper portions of the apertures are disposed entirely in a tapered lower portion of the bulb. Without intending to be bound by theory, the inventors surmise that this configuration can be advantaged in that when suspended from a ceiling it can distribute the load more efficiently in a horizontal direction as well as a vertical direction, thus allowing the device to bear greater loads.

Figure 4:
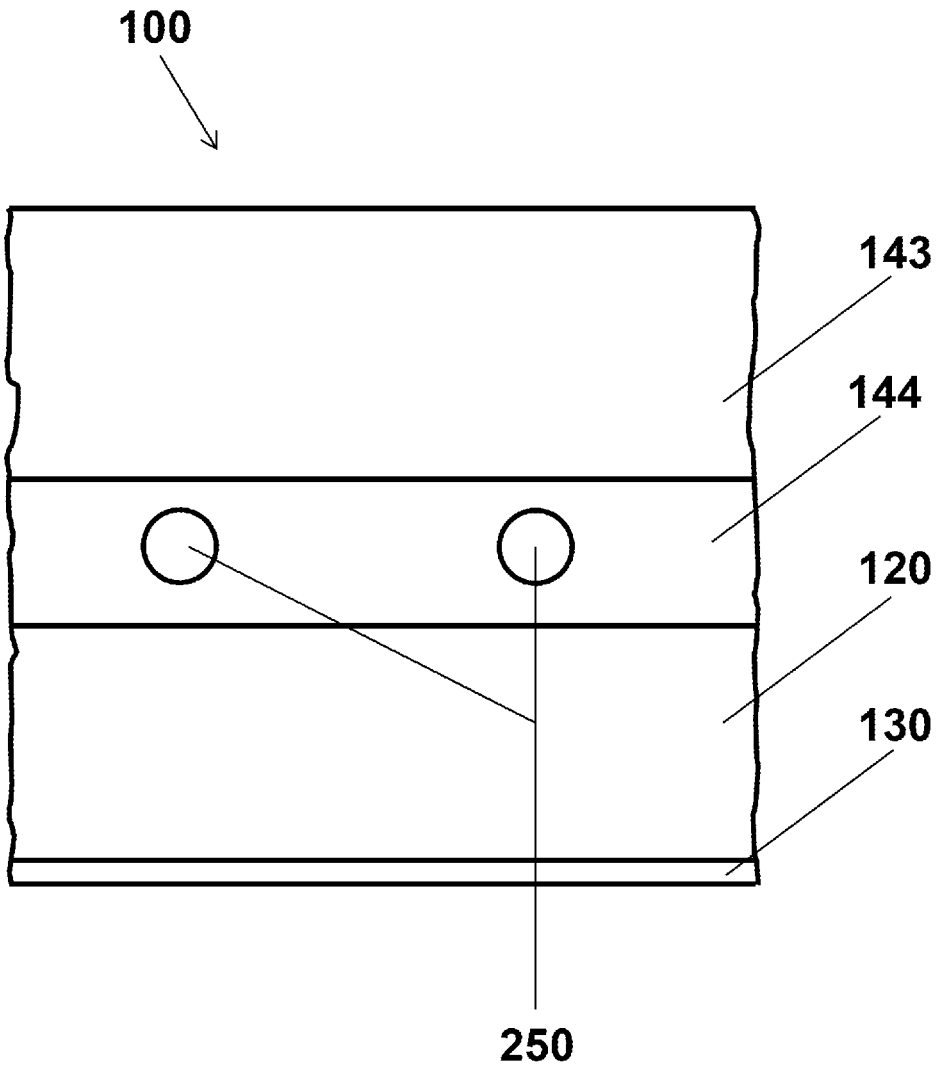
FIG. 4 is a partial schematic side view of a support member according to another embodiment of the disclosure.

In certain embodiments of the devices as otherwise described herein, each aperture is similarly shaped (See, e.g., apertures 150, 250, and 350 of the embodiments shown in FIGS. 3, 4, and 5, respectively). In some embodiments, the series of apertures includes two or more differently shaped apertures. For example, in the embodiment shown in schematic view in FIG. 8, the apertures include oval apertures 653 and circular apertures 654. The different shapes can be provided in an alternating series (e.g., a series of two alternating shapes, a series of three alternating shapes, or a series of four alternating shapes, or a series of six alternating shapes, or a series of eight alternating shapes). In certain embodiments, alternatingly-shaped apertures are regularly-spaced along the length of the support member (e.g., as described below); this can help an installer "count off" distances by counting multiple holes at once. In other embodiments, a plurality of different shapes are provided in groups, e.g., a first plurality of a first shape (e.g., four of them), followed by a first plurality of a second shape (e.g., four of them), followed by a first plurality of a third shape (e.g., four of them), followed by a first plurality of a fourth shape (e.g. four of them). The holes can be regularly spaced. Here, too, an installer can "count off" distances by counting multiple holes at once.

In certain embodiments of the devices as otherwise described herein, the apertures are regularly spaced along the length of the support member. In some embodiments, the apertures are regularly spaced apart by less than about 4 inches, e.g., by less than about 3.75 inches, or less than about 3.5 inches, or less than about 3.25 inches, or less than about 3 inches, or less than about 2.75 inches, or less than about 2.5 inches, or by about 4 inches, or about 3.75 inches, or about 3.5 inches, or about 3.25 inches, or about 3 inches, or about 2.875 inches, or about 2.75 inches, or about 2.625 inches, or about 2.5 inches, or about 2.375 inches, or about 2.25 inches, or about 2.125 inches, or about 2 inches, or about 1.875 inches, or about 1.75 inches, or about 1.625 inches, or about 1.5 inches, or about 1.375 inches, or about 1.25 inches, or about 1.125 inches, or about 1 inch. Spacing is determined on a center-to-center basis. The person of ordinary skill in the art will appreciate that such regularly spaced apertures advantageously offer flexibility when suspending the support member from a structure by a hanger threaded through one of the apertures by allowing small adjustments to the location of the hanger to avoid other building infrastructure components in the plenum above a suspended ceiling, e.g., plumbing, electrical wiring, etc.

In some embodiments, the apertures are equally spaced. In some embodiments, the series of apertures includes groupings of two or more apertures, wherein the apertures within a grouping are spaced by a first length and the groupings are spaced by a second length. For example, in the embodiment shown in FIG. 8, groupings comprising one aperture 653 and one aperture 654 spaced apart by a first length are themselves spaced by a second, different length. But in other embodiments, all apertures are regularly-spaced on a center-to-center basis.

In some embodiments, the width of the lower portion of the bulb, i.e., the distance between the first side of the lower portion of the bulb and the second side of the lower portion of the bulb, tapers monotonically inwards from the upper portion of the bulb to the central web. In certain such embodiments, the interior angle between the first side of the lower portion of the bulb and the first side of the upper portion of the bulb is substantially the same as the interior angle between the second side of the lower portion of the bulb and the second side of the upper portion of the bulb. In certain such embodiments, the interior angle between the first side of the lower portion of the bulb and the first side of the upper portion of the bulb and the interior angle between the second side of the lower portion of the bulb and the second side of the upper portion of the bulb differ by less than 15°, e.g., less than 14°, or less than 13°, or less than 12°, or less than 11°, or less than 10°, or less than 9°, or less than 8°, or less than 7°, or less than 5°, or less than 4°, or less than 3°, or less than 2°. Accordingly, in certain embodiments, the bulb is substantially symmetrical between its first side and its opposed second side. In some embodiments, the width of the lower portion of the bulb is constant, the lower portion of the bulb being connected to the upper portion of the bulb and the central web through, e.g., a series of right angles.

Each aperture has a thickness at its top end and a thickness at its bottom end, each defined by the distance between the first side and the opposed second side of the bulb at the respective top and bottom end of the aperture. The thickness at the top end is denoted in FIG. 1 with the line marked "t", and the thickness at the bottom end is denoted with the line marked "b". In certain embodiments, the thickness of each aperture at its top end is greater than, and desirably substantially greater than, its thickness at its bottom end. For example, in certain embodiments of the devices as otherwise described herein, the thickness of each aperture at its top end is at least 1 mm greater than, at least 2 mm greater than, or even at least 3 mm greater than its thickness at its bottom end. In certain such embodiments, the thickness of each aperture at its top end is no more than 8 mm greater than, no more than 6 mm greater than, or no more than 5 mm greater than its thickness at its bottom end.

When the lower portion of the bulb tapers, the angle of that taper will vary. In certain embodiments, the taper of the lower portion of the bulb (i.e., the average angle of taper over the height of the lower portion of the bulb) can be made to be relatively sharp, e.g., at an angle from vertical in the range of 30 degrees to 80 degrees, e.g., 40 degrees to 80 degrees, or 45 degrees to 80 degrees, or 50 degrees to 80 degrees, or 30 degrees to 75 degrees, or 40 degrees to 75 degrees, or 45 degrees to 75 degrees, or 50 degrees to 75 degrees, or 30 degrees to 70 degrees, or 40 degrees to 70 degrees, or 45 degrees to 70 degrees, or 50 degrees to 70 degrees, or 30 degrees to 65 degrees, or 40 degrees to 65 degrees, or 45 degrees to 65 degrees, or 50 degrees to 65 degrees, or 35 to 45 degrees, or 40 to 50 degrees, or 45 to 55 degrees, or 50 to 60 degrees, or 55 to 65 degrees, or 60 to 70 degrees. Such sharp tapers can provide apertures with thicknesses (i.e., between the first side and the second opposed side of the bulb) that are smaller at the lower portion of the aperture than at the top portion of the aperture, e.g., as described above.

In some embodiments of the devices as otherwise described herein, the central web of the support member includes one or more tabs in-plane with the central web. In some embodiments, the tabs are disposed on one or both ends of the length of the support member. For example, in the embodiment shown in schematic view in FIG. 9, a tab 160 is attached to and extends from central web 120 at an end of the length of support member 100. The tab can be, for example, formed integrally with the support member, or be a distinct piece that is attached to the end of the support member when interconnecting it with another support member (see FIG. 17 below). In some embodiments, the tabs are disposed in the central web such that the tabs may be bent out of the plane of the central web. For example, in the embodiment shown in schematic view in FIG. 10, a tab 170 is disposed in central web 120 and detached from central web 120 on three sides by a cut-out 171. The person of ordinary skill in the art will appreciate that cut-out 171 allows tab 170 to be bent out of the plane of central web 120. The person of ordinary skill in the art will appreciate that there are a variety of means by which the tab may be disposed in the central web such that the tab may be bent out of the plane of the central web, e.g., by perforating three sides of the tab disposed in the central web. In certain embodiments, the central web of one support member can also include one or more apertures (e.g., one or more slots) configured to receive a tab of one or more other support members. Such apertures can be regularly spaced, e.g., on 6 inch centers. Apertures are shown in the views of FIGS. 14-19. Different support members can be interconnected (e.g., in a grid) through the insertion of the tab of one support member to the aperture in the central web of another support member. Such configurations are familiar to the person of ordinary skill in the art.

In some embodiments of the devices as otherwise described herein, the tabs of a first support member are attachable to, e.g., the tabs of a second support member, the central web of a second support member, or to a structure. In some embodiments, the tabs include an attachment point, e.g., a hole for a bolt, etc. In some embodiments, the central web of a first support member includes an attachment point, e.g., a receiving pocket, a hole for a bolt, etc., for the tab of a second support member. The person of ordinary skill in the art will appreciate that the tabs of a first support member may be attached to a second support member through a variety of means known in the art, e.g., a nut and bolt, a rivet, a weld, a receiving pocket, etc.

But the person of ordinary skill in the art will appreciate that the support members described herein can be adapted for interconnection into a grid in a variety of ways, as would be apparent to the person of ordinary skill in the art.

In certain embodiments of the devices as otherwise described herein, the height of the bulb and the web is within the range of about 0.5 inches to about 6 inches, e.g., about 0.5 inches to about 5.5 inches, or about 0.5 inches to about 5 inches, or about 0.5 inches to about 4.5 inches, or about 0.5 inches to about 4 inches, or about 0.5 inches to about 3.5 inches, or about 0.5 inches to about 3 inches, or about 0.75 inches to about 2.75 inches, or about 1 inch to about 2.5 inches, or about 1 inch to about 2.25 inches, or about 1 inch to about 2 inches, or about 1.25 inches to about 1.75 inches.

In certain embodiments of the devices as otherwise described herein, the height of the bulb is within the range of about 0.1 inches to about 2 inches, e.g., about 0.1 inches to about 1.8 inches, or about 0.1 inches to about 1.6 inches, or about 0.1 inches to about 1.4 inches, or about 0.1 inches to about 1.2 inches, or about 0.1 inches to about 1 inch, or about 0.1 inches to about 0.9 inches, or about 0.1 inches to about 0.8 inches, or about 0.1 inches to about 0.7 inches, or about 0.2 inches to about 0.6 inches, or about 0.3 inches to about 0.5 inches.

In certain embodiments of the devices as otherwise described herein, the width of the upper portion of the bulb is within the range of about 0.1 inches to about 1 inch, e.g., about 0.1 inches to about 0.9 inches, or about 0.1 inches to about 0.8 inches, or about 0.1 inches to about 0.7 inches, or about 0.1 inches to about 0.6 inches, or about 0.1 inches to about 0.5 inches, or about 0.1 inches to about 0.4 inches, or about 0.15 inches to about 0.35 inches, or about 0.2 inches to about 0.3 inches.

In certain embodiments of the devices as otherwise described herein, the longest dimension of each aperture is within the range of about 0.1 inches and about 1 inch, e.g., about 0.1 inches to about 0.9 inches, or about 0.1 inches to about 0.8 inches, or about 0.1 inches to about 0.7 inches, or about 0.1 inches to about 0.6 inches, or about 0.1 inches to about 0.5 inches, or about 0.1 inches to about 0.4 inches, or about 0.1 inches to about 0.3 inches, or about 0.1 inches to about 0.2 inches.

In certain embodiments of the devices as otherwise described herein, the top end of each aperture is within no more than 1 inch from the top of the bulb, e.g., no more than 0.5 inches, or even no more than 0.375 inches.

The lower surface 132 of each of the flanges 130 can be patterned, e.g., to form the lowermost surfaces of the support members. These can visible in a room between ceiling tiles, and thus can provide an aesthetic benefit. The patterned lower surfaces of the support members may comprise many different appearances and/or textures. For example, the patterned lower surfaces may be two-dimensional (e.g., printed) or three-dimensional, and may comprise non-smooth textures. The patterned lower surfaces may have features that are uniform and symmetrical (e.g., in two or three-dimensional configurations), non-uniform and irregular (e.g., in three-dimensional configurations), or a combination thereof. The features used to form the different textural appearance may be roll-formed, stamped, embossed, machined or otherwise mechanically formed in the support members. A three-dimensional pattern may be impressed into a thin capping material, which is secured on the lower ends of the t-bar shapes of the support members. In other embodiments, the features are painted, imaged or printed directly on these types of support members, or similarly placed on a flexible adhesive tape that is attached to the support members. Other embodiments of the patterned lower surfaces may include lines which may be parallel and symmetrically arrayed), slots, dimples, protrusions, peaks, and valleys, and/or cross-hatching. When the patterned lower surfaces are three-dimensional, the three-dimension al features may protrude or recede from a reference plane "r" by a distance "d." For example, if the features protrude outward (i.e., downward) from the support members, the reference plane r is defined as the mean plane from which the protrusions extend. If the features protrude inward (i.e., upward) from the support members, the reference plane r is defined as the mean plane from which the recessions recede. In some embodiments, the distanced may comprise about 0.015 to 0.250 inches, about 0.031 to 0.125 inches, or about 0.031 to 0.0625 inches. Patterned support lower surfaces are described in further detail in U.S. Pat. No. 9,091,050, which is hereby incorporated herein by reference in its entirety. In other embodiments, the support member includes features that can interface with strip lighting, as described in U.S. Patent Applications Publications nos. 2016/0061395 and 2016/0017604, each of which is hereby incorporated herein by reference in its entirety. For example, in certain embodiments, the lower surface of the support member (e.g., the lower surface of the one or more flanges) includes a downwardly opening recess that extends in the length of the grid member; the downwardly opening recess can, for example, releasably engage and secure an LED strip light.

The support members can be made using any convenient manufacturing method. For example, the support members may suitably be roll-formed steel or aluminum, extruded aluminum, plastic, or fiber-reinforced plastic, depending on the particular application. In some embodiments of the devices as otherwise described herein, one or more of the bulb, web, and flanges of the support member may be roll-formed steel or aluminum. In some embodiments, the bulb, web, and flanges of the support member are roll-formed aluminum. In some embodiments, one or more of the bulb, web, and flanges of the support member may be extruded aluminum. The metal raw materials (e.g., steel, aluminum, etc.) used in the roll-forming process can, for example, arrive at the plant in coils. This material can be, e.g., about several inches wide, and about 0.012 to 0.020 inches thick, depending on the load rating desired from the finished grid product. For some applications, the steel is about 0.015 inches thick. In one particular method to make the support members described herein, the coils are unwound into a roll forming machine, which comprises a series of roll sets that progressively bend or fold the metal into the final shape desired. Each roll set represents a "step" in the process of roll-forming. Depending on the complexity of the finished shape, the number of roll sets can be as few as two or three (such as for forming a rain gutter), to as many as needed. For ceiling suspension t-bar type grids, the number of roll sets can generally be about 16. A capping material, which also arrives at the plant in coils that are typically about 1 1/16 inches for a 1 5/16 inch-wide grid, can be introduced if desired at one of the later roll sets. This material can be steel or aluminum and is generally white, but could be any color. This material is crimped tightly onto the t-bar shape, which is formed continuously. A shear cuts the finished shape into pieces of the length desired. The slots, holes, and end joinery can all be added later in the process in a press. Of course, the person of ordinary skill in the art will appreciate that any desirable process can be used to make the support members described herein, and that the methods of manufacturing the support members described herein are not limited to the foregoing.

The support members of the present disclosure can be made in a variety of lengths. For example, in certain embodiments, a support member as otherwise described herein has a length in the range from 1 foot to 24 feet, e.g., in the range of 1 foot to 20 feet, or 1 foot to 16 feet, or 1 foot to 12 feet, or 1 foot to 8 feet, or 1 foot to 4 feet, or 2 feet to 24 feet, or 4 feet to 20 feet, or 4 feet to 16 feet, or 4 feet to 12 feet, or 8 feet to 24 feet, or 8 feet to 20 feet, or 8 feet to 16 feet, or 12 feet to 20 feet, or 12 feet to 16 feet. For example, in certain embodiments, a main beam or runner (see below) can be about 12 feet in length, and a cross tee (see below) can be about 2 feet in length or about 4 feet in length.

Another aspect of the disclosure is a ceiling system comprising a support member as otherwise described herein, suspended from a structure (e.g., a ceiling) by a hanger, wherein a portion of the hanger is threaded through one of the apertures of the support member. The person of ordinary skill in the art will appreciate that the support member may be one of several types of support members known in the art (such as, e.g., those described in U.S. Pat. No. 9,091,050, which is hereby incorporated herein by reference in its entirety), such a main runner, a cross tee, etc.

Figure 11:
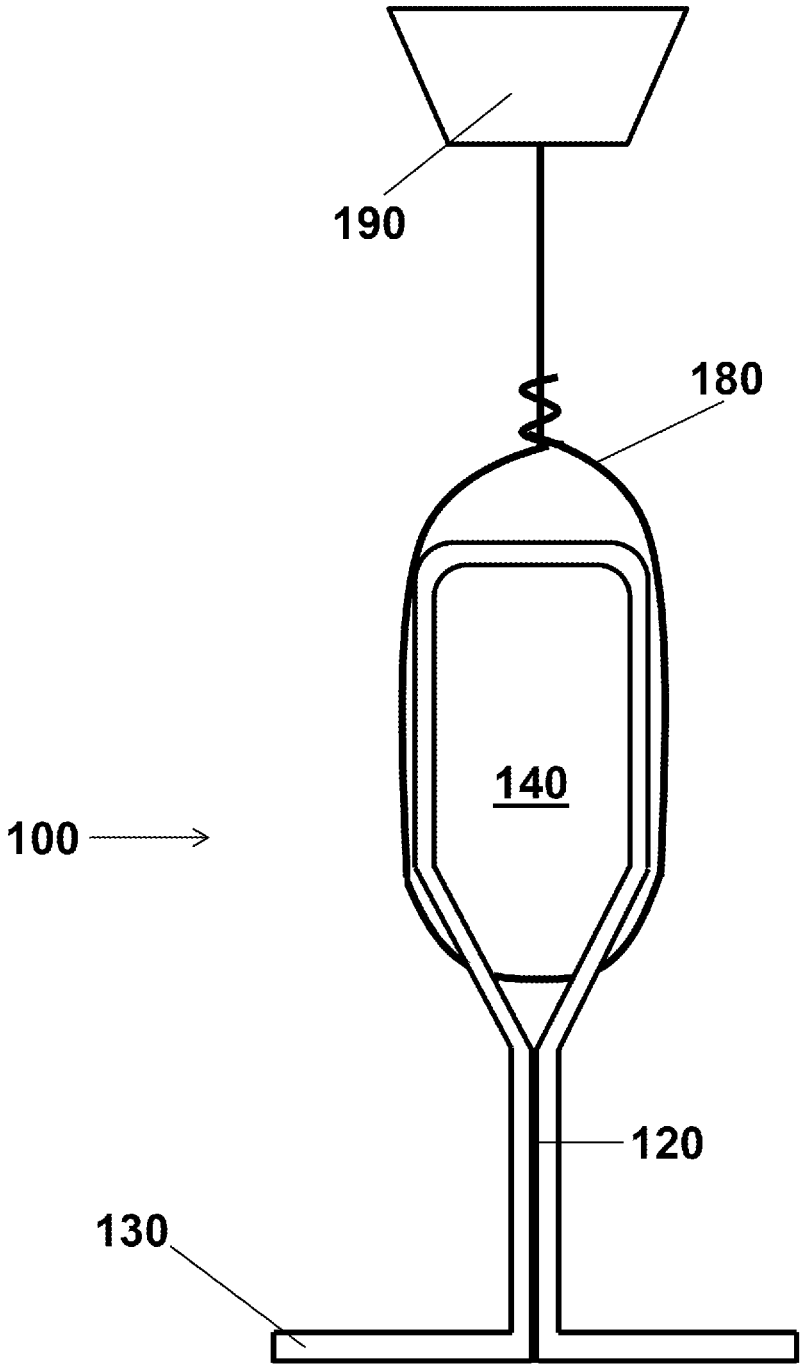
FIG. 11 is a schematic cross-sectional view of a ceiling system according to one embodiment of the disclosure.

In some embodiments of the system as otherwise described herein, the hanger is a hook. In some embodiments, the hanger is a wire. For example, in the embodiment shown in schematic view in FIG. 11, support member 100 is suspended from a structure 190 by a hanger wire 180 threaded through one of the apertures of support member 100. The person of ordinary skill in the art will appreciate that the disposition of the apertures in the bulb, rather than, e.g., the central web, advantageously decreases the likelihood that a hanger threaded through the aperture might interfere with other components of a ceiling system, e.g., ceiling tiles, plumbing, electrical wiring, etc. The person of ordinary skill in the art will further appreciate that the disposition of the apertures in the lower portion of the bulb, wherein the first side and the second side of the bulb are closer together than they are in the upper portion of the bulb, advantageously increases the ease with which a hanger may be threaded through the aperture.

In some embodiments of the ceiling system as otherwise described herein, the system further comprises a ceiling tile having an edge, the edge resting on the upper surface of the flange of the support member. For example, in the embodiment shown in schematic view in FIG. 12, a ceiling tile 200 has an edge 201 resting on upper surface 131 of flange 130.

Figure 12:
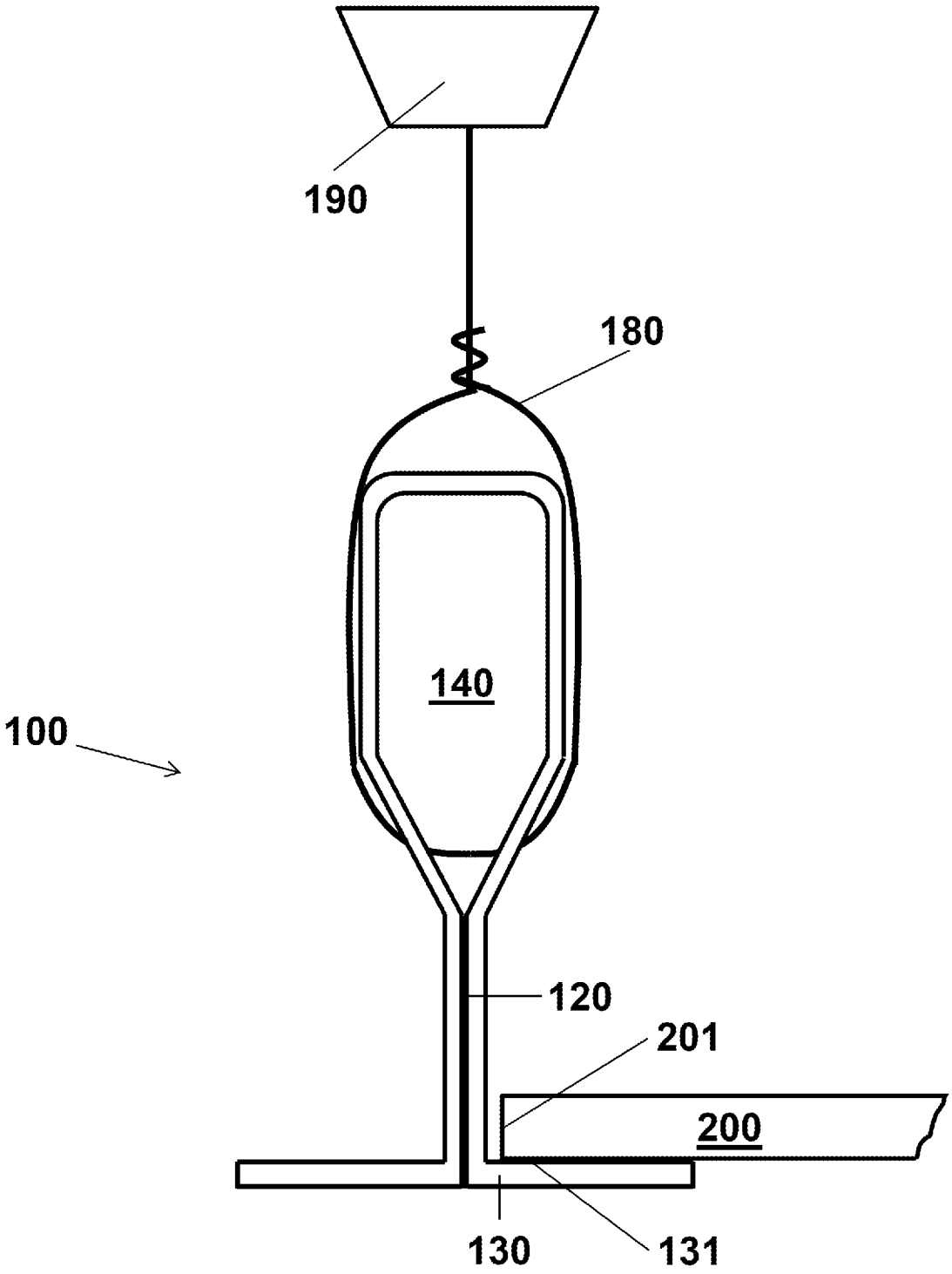
FIG. 12 is a schematic cross-sectional view of a ceiling system according to another embodiment of the disclosure.
Figure 13:
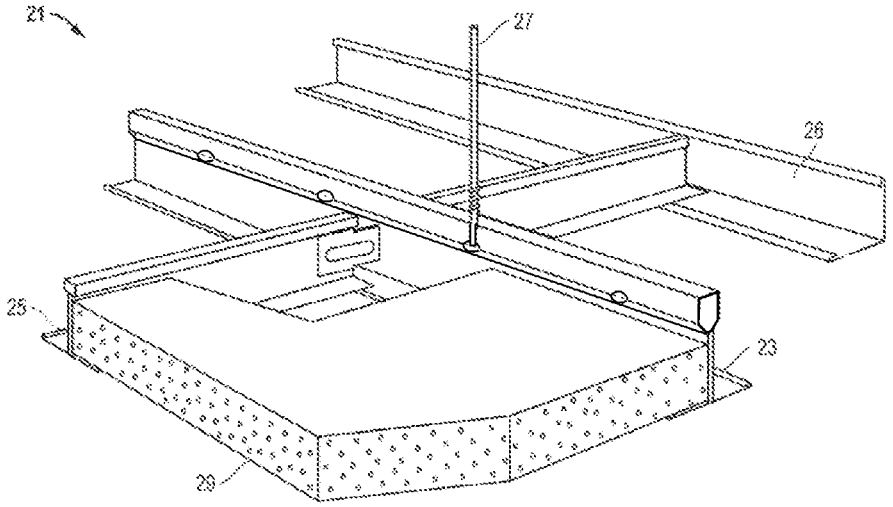
FIG. 13 is a schematic cross-sectional view of a ceiling system according to another embodiment of the disclosure.

Another aspect of the disclosure is a ceiling system comprising a one or more support members as described herein, optionally interconnected with one or more additional support members. The support members can be interconnected, for example, into a grid, as shown in the schematic perspective view of FIG. 13. Various support members may be configured in many forms, such as main beams or runners 23, cross tees 25, and wall angle 26. In the ceiling system 27 of FIG. 13, main beam 23 is configured as a support member as described herein; it is interconnected through intersecting cross-tees 25 to wall angle 26. In certain such embodiments, the support members are interconnected through the attachment of the tab of one support member to the central web or the tab of another support member. In some embodiments, the support members may be substantially perpendicular, such that the interconnected support members form a square or rectangular grid for supporting ceiling tiles. The interconnected support members can be suspended from a ceiling by one or more hangers (e.g., as shown in FIG. 12, or by reference numeral 27 in FIG. 13). In certain embodiments, such a ceiling system further includes a plurality of ceiling tiles (29 in FIG. 13), each ceiling tile being supported by one or more of the interconnected support members by having one or more edges resting on the upper surface of the flanges of the support members. In the embodiment of FIG. 13, the main beam or runner is a support member as described herein; the cross-tees 25 do not have the claimed arrangement of apertures in the bulb. However, in other embodiments (e.g., as shown in FIGS. 16-19 below), the both the main runners and the cross tees are support members as described herein.

Another aspect of the disclosure is a method for making a ceiling system that includes a support member as described herein suspended from a structure (e.g., a ceiling) by a hanger, wherein a portion of the hanger is disposed through an aperture of the support member. The method includes providing a support member as described herein, suspending a hanger from the structure, and inserting the hanger through an aperture of the support member, thereby suspending the support member from the structure. The method can further include providing a ceiling tile having an edge, and disposing the edge of the ceiling tile on the upper surface of a flange of the support member, such that the edge rests on the upper surface of the flange. Moreover, the method can further include interconnecting one support member to another support member through the attachment of a tab of one support member to the central web of another support member. Such methods can include arranging various support members in any manner as described herein.

Figure 14:
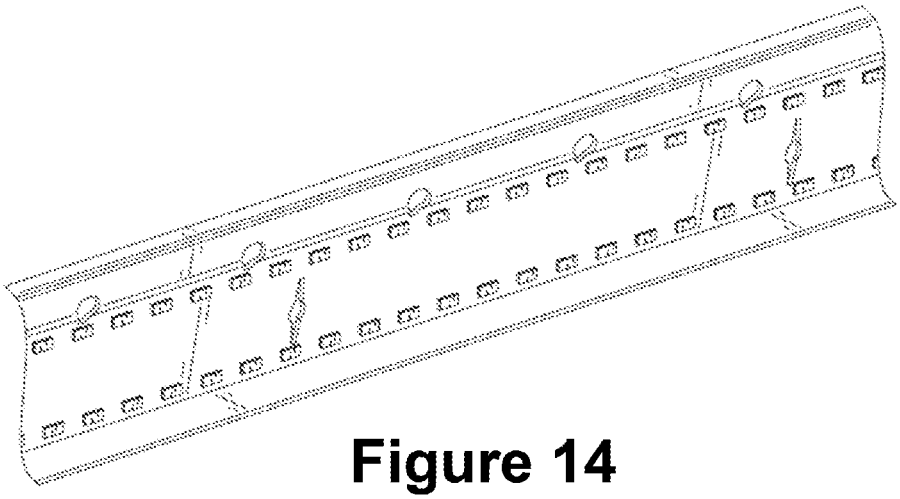
FIG. 14 is a schematic perspective view.
Figure 15:
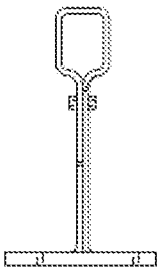
FIG. 15 is a schematic cross-sectional view of a support member according to another embodiment of the disclosure.
Figure 16:
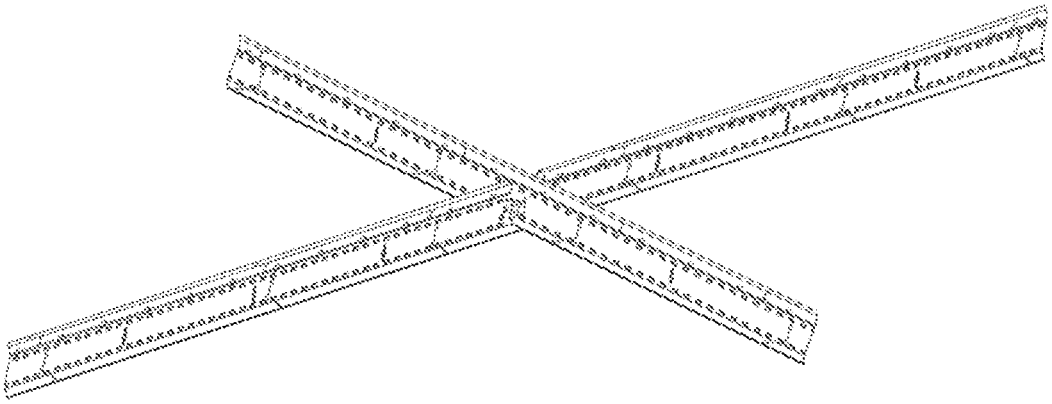
FIG. 16 is a schematic perspective view.
Figure 17:
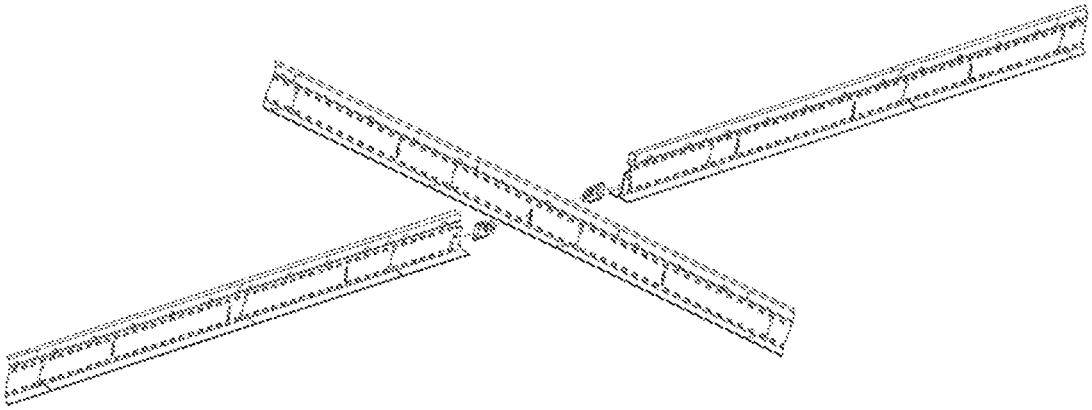
FIG. 17 is a schematic perspective exploded view of a ceiling system according to another embodiment of the disclosure.
Figure 18:
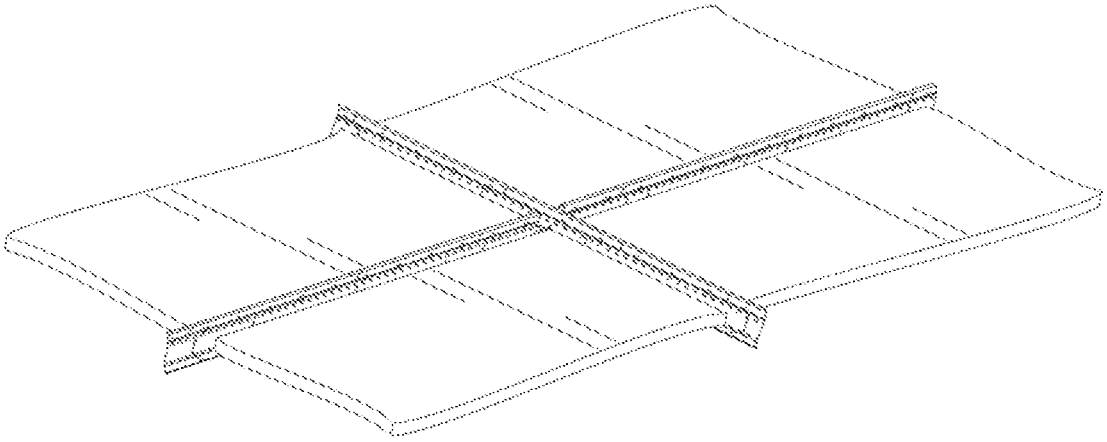
FIG. 18 is a schematic perspective view.
Figure 19:
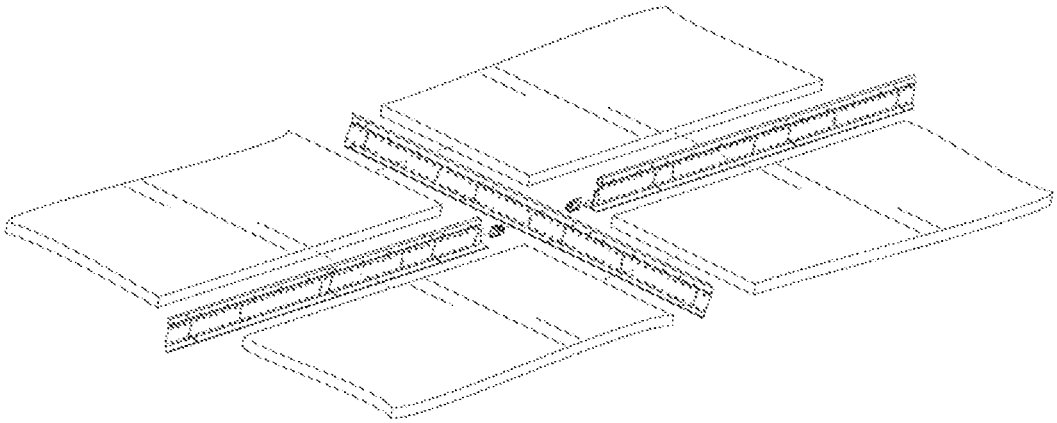
FIG. 19 is a schematic perspective exploded view of a ceiling system according to another embodiment of the disclosure.

Additional embodiments are shown in the various views of FIGS. 14-19. FIG. 14 is a perspective view, and FIG. 15 is a cross-sectional view of a support member of the disclosure. FIG. 16 is a perspective view and FIG. 17 is a perspective exploded view of a system including three support members, joined together by tabs. Here, tabs interconnect the crosspieces with the main runner at a slot formed in the web of a support member. And Figures FIG. 18 is a perspective view and FIG. 19 is a perspective exploded view of the system of FIGS. 16 and 17 including ceiling tiles having their edges disposed on the flanges of the support members.

The invention claimed is:

1. A ceiling system comprising a linearly-extending support member hung from a structure by a hanger and a ceiling tile having an edge, the support member having a length and a cross-sectional shape comprising:

a central web with a first end and a second end;

at least one flange extending substantially perpendicular to the second end of the web, the flange having an upper surface and a lower surface; and a bulb extending from the first end of the web, wherein the bulb having a first side and an opposed second side with a cavity therebetween, the bulb having an upper portion and a lower portion, the lower portion of the bulb being disposed adjacent the first end of the web, wherein at least a portion of the lower portion of the bulb is narrower than the upper portion of the bulb and wider than the central web, and wherein the width of the lower portion of the bulb tapers inward from the upper portion of the bulb to the central web, the bulb comprising a series of spaced apertures formed therein through both the first side and the second side of the bulb, each aperture being disposed at least partially through the tapered lower portion of the bulb, each of the apertures having a rounded upper portion;

wherein the hanger is placed through at least one of the apertures on the first side of the bulb and at least one of the apertures on the second side of the bulb, and wherein the edge of the ceiling tile rests on the upper surface of the flange of the support member.

2. The ceiling system of claim 1, wherein each of the apertures is a D-shaped aperture having the rounded upper portion and a straight lower portion.

3. The ceiling system of claim 1, wherein each of the D-shaped apertures are elongated in a direction parallel to the length of the support member.

4. The ceiling system of claim 1, wherein each of the apertures is oval-shaped.

5. The ceiling system of claim 1, wherein the entire lower portion of the bulb is narrower than the upper portion of the bulb.

6. The ceiling system of claim 1, wherein the taper of the lower portion of the bulb is in the range of 30 degrees to 80 degrees.

7. The ceiling system of claim 1, wherein the angle between the first side of the upper portion of the bulb and the first side of the lower portion of the bulb is substantially the same as the angle between the second side of the upper portion of the bulb and the second side of the lower portion of the bulb.

8. The ceiling system of claim 1, wherein the upper portion of each of the apertures does not include a feature having an angle of less than 135 degrees and a radius of curvature less than 1 mm.

9. The ceiling system of claim 1, wherein the lower portion of each of the apertures does not include a feature having an angle of less than 135 degrees and a radius of curvature less than 1 mm.

10. The ceiling system of claim 1, wherein the apertures are disposed entirely in the lower portion of the bulb.

11. The ceiling system of claim 1, wherein the apertures are formed partially in the lower portion of the bulb and partially in the central web.

12. The ceiling system of claim 1, wherein the apertures are only partially disposed in the lower portion of the bulb, and partially disposed in the upper portion of the bulb.

13. The ceiling system of claim 1, wherein the upper portion of each of the apertures are disposed entirely in a tapered lower portion of the bulb.

14. The ceiling system of claim 1, wherein the apertures are spaced apart by no more than about 4 inches.

15. The ceiling system of claim 1, wherein the thickness of each of the apertures at its top end is at least 2 mm greater than its thickness at its bottom end.

16. The ceiling system of claim 1, wherein the height of the cross section of the lower portion of the bulb is less than the height of the cross section of the upper portion of the bulb.

17. The ceiling system of claim 1, wherein the height of the cross-section of the bulb and the web is within the range of about 0.5 inches to about 6 inches;

the width of the upper portion of the bulb is within the range of about 0.1 inches to about 1 inch; and the longest dimension of each aperture is within the range of about 0.1 inches to about 1 inch.

18. The ceiling system of claim 1, wherein the central web comprises one or more tabs in-plane with the central web, each tab being disposed on either end of the length of the support member or disposed in the central web, wherein the tab may be bent out of the plane of the central web.

* * * * *